United States Patent [19]

Lubojatsky et al.

[11] 4,092,831

[45] June 6, 1978

[54] ROOF BAR FOR SURFACE SUPPORT ELEMENTS

[75] Inventors: Walter Lubojatsky, Recklinghausen; Wilhelm Wertelewski, Datteln, both of Germany

[73] Assignee: Becorit Grubenausbau GmbH, Recklinghausen, Germany

[21] Appl. No.: 692,248

[22] Filed: Jun. 3, 1976

[30] Foreign Application Priority Data

Jun. 5, 1975 Germany ..... 2525034

[51] Int. Cl.[2] ..... E21D 15/44

[52] U.S. Cl. ..... 61/45 D

[58] Field of Search ..... 61/45 D; 299/31-33; 248/357; 91/170 MP

[56] References Cited

U.S. PATENT DOCUMENTS

| | | | |
|---|---|---|---|
| 3,376,707 | 4/1968 | Dommann | 61/45 D |
| 3,728,863 | 4/1973 | Hidasi | 248/357 |
| 3,739,586 | 6/1973 | Wehner et al. | 61/45 D |
| 3,837,170 | 9/1974 | Martinko et al. | 61/45 D |
| 3,903,703 | 9/1975 | Lubojatsky | 61/45 D |
| 3,911,686 | 10/1975 | Becker et al. | 61/45 D |

*Primary Examiner*—Dennis L. Taylor

*Attorney, Agent, or Firm*—Allison C. Collard

[57] ABSTRACT

A roof bar for surface support elements having an L-shaped gap sealing plate which is fixed to at least one side of the roof bar and displaceable toward an adjacent roof bar. The vertical section of the roof bar is formed as a buffer plate for engaging a pivoted hydraulic cylinder supported on the roof bar. A horizontal section of the gap sealing plate is held in a guide below the top plate of the roof bar.

8 Claims, 2 Drawing Figures

ROOF BAR FOR SURFACE SUPPORT ELEMENTS

This invention relates to a roof bar for face support elements with an L-shaped gap sealing plate, which is fixed to at least one side of the roof bar, is displaceable towards an adjacent roof bar, and on whose vertical section, formed as a buffer plate, there engages a pivoted hydraulic cylinder, supported on the roof bar.

The gap sealing plates fixed to such roof bars should prevent dust and small pieces of material from getting between adjacent roof bars. The dust particles carried by a current of air can cause severe injuries if for example, they get into the eyes of someone working in the face. The dust carried in the current of air also causes the wellknown occupational diseases. Moreover, the gap sealing plates in connection with the hydraulic cylinders engaging on it, make possible the lateral alignment of surface support elements.

With a roof bar of a powered shield support assembly known from German patent DT-OS 2 210 757, a connecting rod is fixed between the vertical section of the gap sealing plate and the hydraulic cylinder. This connecting rod is situated inside a guide tube for the gap sealing plate, whose section extends in the horizontal direction and lies on the cover plate of the roof bar. Thus, there is a relatively wide construction, lateral to the direction of advance, which can without difficulty, be accommodated in a powered shield support assembly.

The horizontal section of the gap sealing plate lying on the cover plate is fixed between the roof and the cover plate of the roof bar in powered shield support assemblies when set. In this position the gap sealing plate is unmovable, and cannot fulfill its function if, for example, an adjacent powered shield support assembly which embodies no movable gap sealing plate on this side, is moved and thereby gets into such a position that a gap results between the adjacent gap sealing plates. The known arrangement moreover has the disadvantage that the horizontal section of the gap sealing plate is completely exposed to the roof and can be deformed by unevennesses in the roof. A deformed gap sealing plate is largely inoperable and must be replaced by a new one.

It is an object of the invention to improve the operation of the gap sealing plate and particularly to provide a movement of the gap sealing plate in surface support elements when set, as well as to prevent deformities of the gap sealing plate.

To solve this problem the horizontal section of the gap sealing plate is held in a link underneath the cover plate of the roof bar. Through this arrangement, the operation of the gap sealing plate is independant of the actual position of the surface support element. The gap sealing plate can, if necessary, be brought into contact even in a set surface support element, for aligning an adjacent surface support element. As the horizontal section of the gap sealing plate is held in a link beneath the cover plate of the roof bar, the roof does not however act in the region of the cover plate, hence directly on the gap sealing plate, which is therefore better protected against deformities.

The protection of the gap sealing plate against deformities is improved when the horizontal section is held in a guide pivotable in a vertical plane, and the hydraulic cylinder is pivoted directly to the vertical section about a horizontal axis. Thereby, the two points of support of the hydraulic cylinder and the bearing point of the horizontal section of the gap sealing plate in the guide form a flexible triangle whose sides which are formed from the gap sealing plate are flexible so that during setting of the surface support element or during the movement of the gap sealing plate, they can accommodate obstacles formed by the roof or by the adjacent surface support element. In this way, unevennesses of the roof can no longer lead to deformities of the gap sealing plate.

The resilience of the gap sealing plate in a vertical direction can be achieved and adjusted by the fact that a flat spring which runs essentially parallel to the horizontal section and which is conveyed in a further guide of the roof bar is attached to the vertical section. By suitable dimensioning of the flat spring, a large undesired resilience can be avoided.

One gets a simple arrangement in the constructive respect, if the guide for the horizontal section is formed between the underside of the cover plate and at least one arm of an L-shaped bracket fixed under the cover plate which runs essentially parallel to it. The bracket can be brought up to form the guide for the flat spring, at the same time as this guide is formed between the underside of the free arm of the bracket and a plate situated under it. In addition, the resilience of the flat spring and of the gap sealing plate can be influenced by suitable dimensioning of the width of this plate.

The operation of the horizontal section of the gap sealing plate is improved if a reinforced bulb is attached to the free arm of the bracket on the underside of the horizontal section. The bearing surface or the bearing line of this bulb on the bracket then forms the horizontal axis, about which the horizontal section of the gap sealing plate is pivoted in a vertical plane.

The flat spring can embody on its free end, a guide which interacts with the bracket, and by which the displacement of the gap sealing plate is limited.

It can be advantageous to attach the flat spring flexibly about a horizontal axis to the vertical section, in order to achieve a parallelogram-like movement of this section between the flat spring and the hydraulic cylinder.

The roof bar in accordance with the invention is advantageously suitable for a symmetric construction in which the gap sealing plates are attached on both sides of the roof bar. In this case, the horizontal section of the gap sealing plate can on one side of the roof bar be held in the guide pivotable in a vertical plane, and can be connected to the roof bar by a rod pivoted about horizontal axes at both ends. This gap sealing plate, which is held unmovable on the roof bar by the rod, is however pivotable and is protected against deformities on account of the resilience connected with it. If desired, the rod can be exchanged for a hydraulic cylinder.

Other objects and features of the present invention will become apparent from the following detailed description when taken in connection with the accompanying drawings which disclose an embodiment of the invention. It is to be understood that the drawings are designed for the purposes of illustration only, and are not intended as a definition of the limits and scope of the invention.

In the drawings wherein similar reference numerals denote similar elements throughout the two views.

Figure 1:
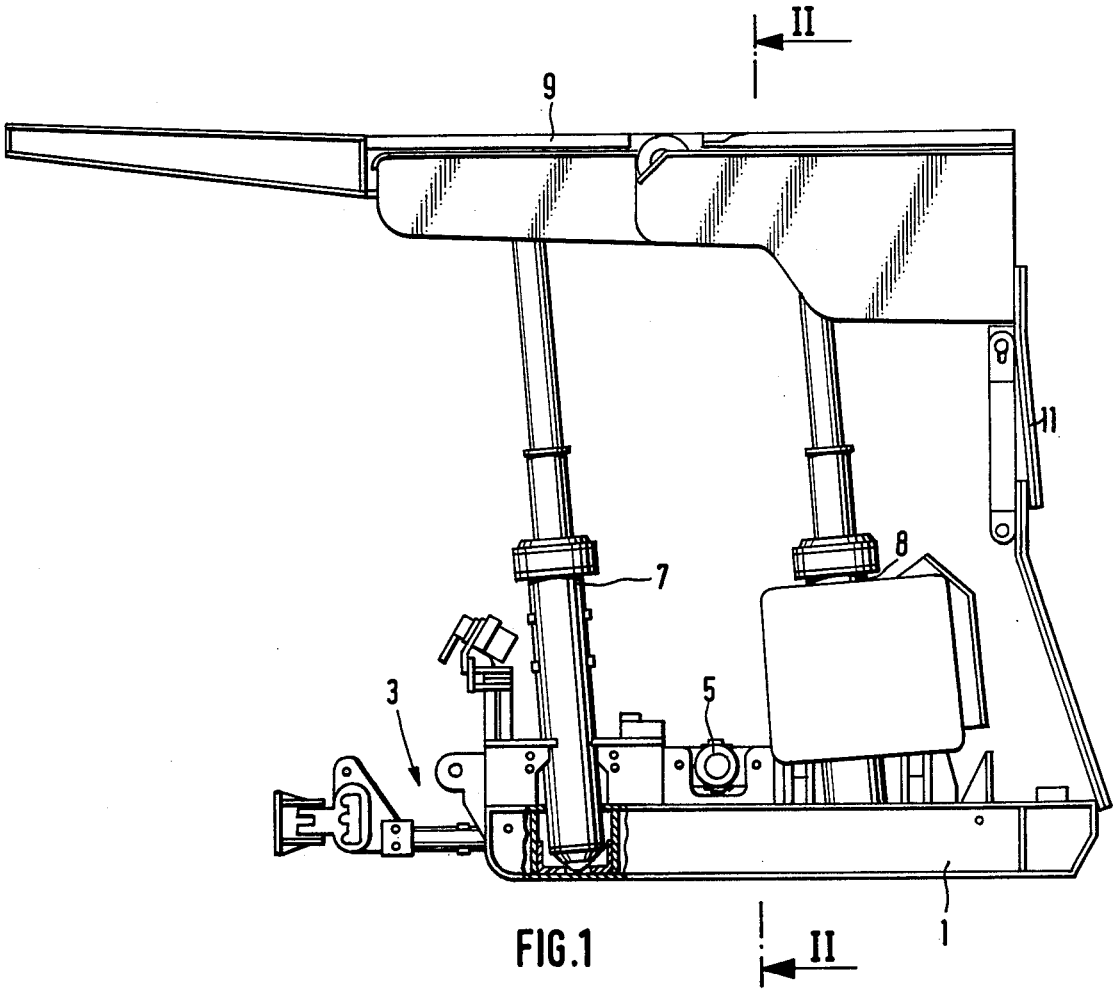
FIG. 1 is a side view of a powered support assembly of the advancing roof bar support according to the invention.

The adjacent powered support assemblies exhibit floor rails 1 and 2, arranged essentially parallel to each other, and on their working surface ends, devices 3 for the attachment of a surface conveyor (not shown). Floor rails 1 or 2 of the adjacent powered support assemblies are connected by a slewing cylinder 4, which is pivoted in sockets 5 or 6 of floor rails 1 or 2. Each floor rail 1 or 2 carries a prop 7 on its working surface side and a further prop 8 on its goaf side. Props 7, 8 of each floor rail 1 or 2 together carry a roof bar 9 or 10. Roof bars 9 or 10 extend on the working surface side right over the face conveyor and carry on the goaf side a stowing shield 11. The powered support assemblies each exhibit a further floor rail, not represented in the diagram, which is rigidly connected to the represented floor rail 1 or 2. These further floor rails likewise carry props, which in turn support the parts of the roof bar not represented in the diagram.

Roof bars 9 or 10 are box-shaped and exhibit a cover plate 12 or 13 which is connected to an underplate 16 or 17 by struts 14 or 15. On the adjacent roof bar sides of both powered support assemblies, cavities are formed between cover plates 12 or 13 and underplates 16 or 17; L-shaped brackets 18 or 19, attached to cover plates 12 or 13, project into these cavities, and guides 22, 23 are formed between their free arms 20 or 21 and cover plates 12 or 13. Further guides 24 or 25 are formed between the undersides of arm 20 or 21 and under plates 16 or 17.

Sections 26, 27 of gap sealing plates which extend horizontally are housed in guides 22 or 23 formed between cover plates 12 or 13 and brackets 18 or 19.

Figure 2:
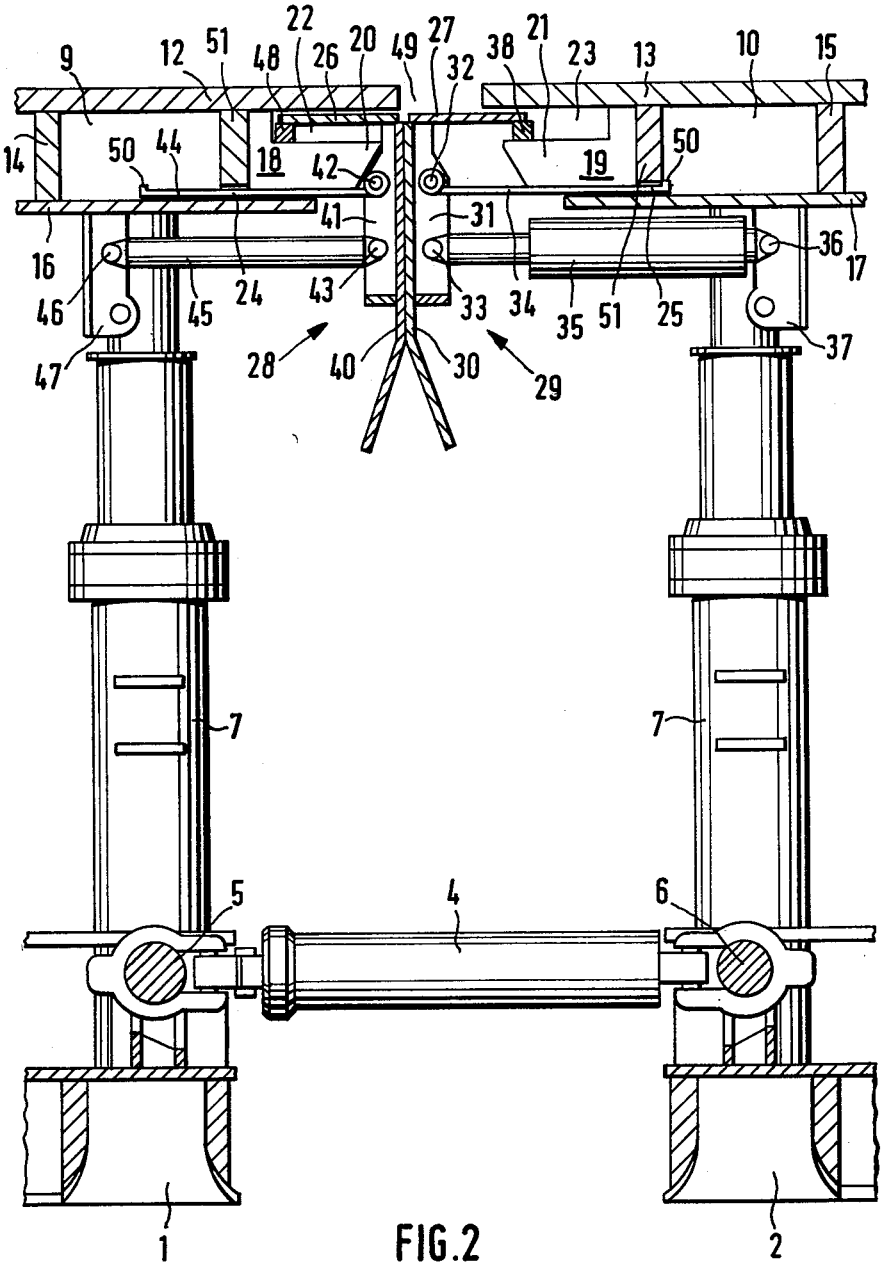
FIG. 2 is a section through the adjacent parts of two powered support assemblies corresponding to the section II—II of FIG. 1.

The gap sealing plate 29 of the surface support assembly resting on floor rail 2, represented in the form of construction in accordance with FIG. 2, on the right side, can be moved towards the adjacent face support assembly and pivoted in a vertical plane, whereas gap sealing plate 28 of the surface support assembly resting on floor rail 1 is fixed positionally, yet pivotable in a vertical plane.

In particular, gap sealing plate 29 embodies a section 30. This section extends in a vertical direction, is attached to section 27 which extends in a horizontal direction, and whose end towards the surface support assembly is angular. On the frame side, vertical section 30 embodies a strut 31 with two bearings 32, 33, in which on one side a flat spring 34 conveyed in guide 25 is housed, and on the other side, a hydraulic cylinder 35 is pivoted about a horizontal axis. Hydraulic cylinder 35 is likewise pivoted with its other end at 36 about a horizontal axis in a bracket attached to the under plate 17. Section 27 of gap sealing plate 28 which extends in a horizontal direction, carries on its end situated in guide 23, a bulb 38 which lies on arm 21 of bracket 19.

Gas sealing plate 28 of the surface supporting assembly resting on floor rail 1 and represented in FIG. 2 on the left side is formed in a similar way. This gap sealing plate embodies a vertical section 40 with an angular end towards the face support assembly and a strut 41 with bearings 42 and 43, in which flat spring 44 conveyed in guide 24, or a rod 45 are pivoted about horizontal axes. Rod 45 is pivoted about a horizontal axis with its other end at 46 in a bracket 47 fixed under plate 16. Similarly section 26 of the gap sealing plate which extends in a horizontal direction exhibits a bulb 48, which lies on arm 20 of bracket 18.

Gap 49 occurring between the two cover plates 9 or 10 is covered by gap sealing plate 29 and held flexible in a vertical direction by flat spring 34. In addition, gap sealing plate 29 is pushed so far forward in the direction of the adjacent powered support assembly, with the help of hydraulic cylinder 35, that vertical sections 30 and 40 lie against each other. A stop 50, which is situated at the free end of flat spring 34, and which interacts with a strut 51 attached to the rear side of bracket 19, prevents gap sealing plate 29 and thus flat spring 34 from being pushed so far forward that flat spring 34 experiences an undesired bending.

If during the advance of gap sealing plate 28, or during the setting of the powered support assembly resting on floor rail 2, unevennesses of the roof extend into gap 49 and prevent the further movement of the gap sealing plate 29, then gap sealing plate 29 yields flexibly, because it can swing in a vertical plane about a horizontal axis available in the region of bulb 38, whereby flat spring 34 is deformed and hydraulic cylinder 35 is swung about bearing 36. As the hydraulic system which feeds hydraulic cylinder 35 only exhibits relatively small pressure, changes in the piston stroke of hydraulic cylinder 35 are also possible.

Gap sealing plate 28 behaves similarly, if unduly high forces which it avoids resiliently, are applied on section 40 which extends in a vertical direction. Thereby only swinging movements in a vertical plane are possible, because gap sealing plate 28 is prevented by rod 45 at a fixed position. It is however possible to replace rod 45 by a hydraulic cylinder 35 and thus to produce a roof bar with movable gap sealing plates 28 or 29 fixed on both sides.

However even when gap sealing plates 28 or 29 are tilted, the cover of gap 49 is maintained, so that dust or gritty material cannot penetrate into the surface area.

The gap sealing plates can moreover serve to align the adjacent surface support elements against each other. It can also be necessary to charge hydraulic cylinder 35 with a higher pressure, than was necessary, just to achieve a tight sealing of gap sealing plates 28 or 29 against each other. As pressure medium with this higher pressure is available, only the corresponding valves are required.

While only a single embodiment of the present invention has been shown and described, it will be obvious to those skilled in the art that many changes and modifications may be made thereunto without departing from the spirit and scope of the invention.

What is claimed is:

1. In an improved roof bar for surface support elements of the type which includes a top plate, an L-shaped gap sealing plate having horizontally-disposed, upper section and a vertically-disposed, lower section which serves as a buffer plate, said gap sealing plate being coupled to at least one side of said roof bar and being displaceable generally toward an adjacent roof bar, a pivotable hydraulic cylinder coupled to said buffer plate and to said roof bar, the improvement comprising:

a first guide element rigidly mounted on said roof bar beneath said top plate thereof, said first guide element defining, in cooperation with said top plate, a horizontally-extending channel therebetween in which said upper horizontally-disposed section of said gap sealing plate is slidably mounted.

2. The roof bar according to claim 1, wherein said first guide element comprises an L-shaped bracket having a vertically-disposed upper leg which depends from the lower surface of said top plate and a horizontally-disposed lower leg which defines, in cooperation with said top plate, said channel for slidably mounting said upper section of said gap sealing plate.

3. The roof bar according to claim 2, wherein said upper horizontally-disposed section of said gap sealing plate is pivotable about a vertical axis and said hydraulic cylinder is pivotably coupled to said vertically-disposed buffer plate to permit movement of said buffer plate about a vertical axis.

4. The roof bar according to claim 3 additionally including a second guide element parallel to, and disposed beneath, and spaced from said lower leg of said L-shaped bracket to define therebetween a second horizontally-extending channel, and a flat elongated spring slidably mounted in said second channel, one end of said spring being secured to said lower leg of said L-shaped gap sealing plate.

5. The roof bar according to claim 4, wherein said second guide element comprises a bottom plate spaced from and parallel to said top plate, said bottom plate being coupled to said top plate.

6. The roof bar according to claim 4, wherein said upper leg of said gap-sealing plate has a bulge member secured to the underside of its free end, which is slidably supported on said lower leg of said L-shaped bracket.

7. The roof bar according to claim 4, wherein said spring has a stop formed at the other end thereof which interacts with said L-shaped bracket to limit sliding movement thereof.

8. The roof bar according to claim 4 wherein said one end of said flat spring is flexibly secured to said lower leg of said L-shaped gap sealing plate about a horizontal axis.

* * * * *